US005791963A

United States Patent [19]

Lieberman

[11] Patent Number: 5,791,963

[45] Date of Patent: Aug. 11, 1998

[54] REVERSIBLE DOLL/HAT

[75] Inventor: Jerry Lieberman, Yorktown Heights, N.Y.

[73] Assignee: Chameleon Products, Inc., Merrick, N.Y.

[21] Appl. No.: 815,657

[22] Filed: Mar. 13, 1997

[51] Int. Cl.[6] ..... A63H 3/02; A42B 1/00

[52] U.S. Cl. ..... 446/27; 446/72; 446/76; 2/195.3; 2/209.13; D2/866

[58] Field of Search ..... 446/27, 71, 72, 446/76; 2/183, 195.3, 209.11, 209.12, 209.13; D2/866

[56] References Cited

U.S. PATENT DOCUMENTS

| | | | |
|---|---|---|---|
| 4,080,665 | 3/1978 | Hodes | 2/209.1 |
| 4,413,442 | 11/1983 | McSweeney | 46/151 |
| 4,543,669 | 10/1985 | Katz | 2/84 |
| 4,610,038 | 9/1986 | Dennard | 2/209.1 |
| 4,614,505 | 9/1986 | Schneider et al. | 446/372 |
| 4,620,842 | 11/1986 | Wang | 434/135 |
| 4,695,264 | 9/1987 | McLeod, Jr. | 446/321 |
| 4,715,840 | 12/1987 | Swift | 446/74 |
| 4,734,074 | 3/1988 | Park | 446/321 |
| 4,763,369 | 8/1988 | Spector | 5/434 |
| 4,781,648 | 11/1988 | Garfinkel | 446/321 |
| 4,795,398 | 1/1989 | Wexler | 446/327 |
| 4,842,565 | 6/1989 | VonPhilp, Sr. | 446/321 |
| 4,883,441 | 11/1989 | Byer | 446/99 |
| 5,090,938 | 2/1992 | Reynolds | 446/369 |
| 5,214,802 | 6/1993 | McCallum | 2/196 |
| 5,287,561 | 2/1994 | Spector | 2/209.11 |
| 5,303,427 | 4/1994 | Fishbaine | 2/209.11 |
| 5,328,399 | 7/1994 | Reynolds | 446/27 |
| 5,348,510 | 9/1994 | DuPont et al. | 446/100 |
| 5,428,843 | 7/1995 | Clowers et al. | 2/195.2 |
| 5,450,629 | 9/1995 | Gilstrap | 2/209.11 |
| 5,561,864 | 10/1996 | DeMars | 2/209.13 |

*Primary Examiner*—Robert A. Hafer
*Assistant Examiner*—Laura Fossum
*Attorney, Agent, or Firm*—Pennie & Edmonds LLP

[57] ABSTRACT

The invention relates to a reversible doll/hat that can be altered from a doll shape into a wearable hat and back to a doll. The doll/hat has a doll portion and a hat portion, where the doll portion defines an internal cavity, and has a head portion, a torso portion fixedly attached to the head portion, an aperture having a perimeter that provides access to the interior cavity, and a zipper for closing the aperture. The hat portion has a crown having a front, a back, an exterior, an interior, and an inner periphery, a brim fixedly attached at the front of the crown, and a headband fixedly attached to and extending around the inner periphery of the crown. The headband is associated with the perimeter of the aperture, such that the perimeter of the aperture and the zipper each form part of the headband. In a first configuration, the hat portion is placed within the internal cavity of the doll portion, such that at least part of the brim functions as stuffing for the doll head and at least part of the crown functions as stuffing for the doll torso. In a second configuration, the hat portion can assume the shape of a wearable hat. The doll portion can be collapsed and placed within the interior of the crown of the hat, so that the doll portion is not visible when the hat is worn.

19 Claims, 3 Drawing Sheets

REVERSIBLE DOLL/HAT

FIELD OF THE INVENTION

The present invention is directed to a reversible doll/hat that can be converted from a hat to a doll and back to a hat by a simple manipulation.

BACKGROUND OF THE INVENTION

Hats that can be converted into other objects and back are known. For example U.S. Pat. Nos. 4,610,038, 5,214,802, 5,303,427, and 5,450,629 disclose hats that convert to various bags and purses.

Toys that can be converted from one toy to a second toy and back are also known. For example, U.S. Pat. No. 4,842,865 discloses a stuffed doll formed of two fabric sections with a cavity containing filling material between the sections. Each fabric section has accent devices on its outer facing surface to provide two different appearances of a toy animal or person. An additional fabric section is provided to conceal one of the two appearances, and can be moved, when desired, to conceal the other appearance.

U.S. Pat. No. 4,795,398 discloses a doll and flower-in-pot combination that converts to a hand puppet. A doll head is pivotally attached to a hollow body that is attached to a sleeve. When the sleeve is folded over the body and the head is folded down, the combination appears to be a flower pot. When the head is raised or the sleeve is pulled down or both, a doll having an internal cavity is provided that may be used as a hand puppet.

U.S. Pat. No. 4,781,648 discloses a reversible toy having a pair of substantially equal size fabric skins, peripherally secured, and configured to enclose one skin while exposing the other. Each skin has multiple appendages that, when stored, provide bulk stuffing for the appendages of the exposed skin. The inversion of the toy from one configuration to the other is effected through an opening along a relatively inconspicuous portion of the toy. The opening has an appropriate closure means, typically a zipper, to close the opening.

U.S. Pat. No. 4,695,264 discloses a toy including two reversible figures that are joined to each other. Each figure has a separate internal cavity having the capacity to hold or contain the other figure. The figures are joined along a common opening and at a point preferably opposite the opening, such that as one figure is folded out through the opening, the other figure is drawn through the opening and into the internal chamber of the figure being folded outward to form stuffing for the figure. Closure means, typically a double acting zipper, are provided to open and close the common opening.

U.S. Pat. No. 4,614,505 discloses a transformable toy figure having a structure that allows the progressive transformation from one configuration to another. The toy figure has a body portion secured to a special fabric segment that defines a resiliently deformable pocket with a resiliently deformable opening. The toy is transformed by forcing selected portions of the body through the opening. Once the transformation is complete, the opening is allowed to contract, enclosing the body portion to maintain the figure in the transformed configuration.

U.S. Pat. No. 5,328,399 discloses an article that is transformable from a first shape associated with an activity, such as a sport or a sports team, to a second shape associated with the same sport or sports team, e.g., a toy race car and toy a race driver's helmet or a toy football and a toy football helmet or a toy in the shape of a team mascot. While the article is in the first shape, the pliable portion used to form the second shape is collapsed, and stored in an internal hollow region within the first portion. To convert the toy to the second shape, the second portion is extracted from the internal hollow by pulling it through an aperture in the first portion, and the first portion is then inserted through the aperture in the second portion for storage. A closing means, such as a loop fastener or zipper is used to close the aperture when the article is in the configuration of either the first shape or the second shape.

In addition, hats or garments that can be converted into toys and back are also known. For example, U.S. Pat. No. 5,287,561 discloses a hat that converts into a flying play object. The fabric hat is formed by a pair of dome-shaped sections, where one is nested within the other to form the crown of the hat. The circular rims of the two sections are joined to an annular disk that forms the brim of the hat. The hat is converted into a flying object by inserting a collapsed toy balloon through a port in one of the crown sections, and inflated to form a ball encircled at its equator by the annular disc.

U.S. Pat. No. 4,543,669 discloses a combination toy and garment having a toy portion and a garment portion that are attached together to form an article of clothing, such as a sweatshirt or other article of outerwear. When the garment portion is enfolded by the toy portion, the combination takes on the shape of a stuffed toy. The article of clothing can range from a jumpsuit to a cape, and may or may not include a hood. A fastening means, such as a zipper, forms parts of the boundary between the garment and toy portions, and is attached such that when the garment portion is unfolded by the toy portion, the fastening means may be engaged to retain the shape of the stuffed toy.

SUMMARY OF THE INVENTION

The invention relates to a reversible doll/hat that can be altered from a doll shape into a wearable hat and vice versa. The doll/hat comprises a doll portion and a hat portion, where the doll portion defines an internal cavity, and comprises a head portion, a torso portion fixedly attached to the head portion, an aperture having a perimeter that provides access to the interior cavity and closing means for closing the aperture, such as a zipper.

The hat portion comprises a crown having a front, a back, an exterior, an interior, and an inner periphery, a brim fixedly attached at the front of the crown, and a headband fixedly attached to and extending around the inner periphery of the crown. The headband is associated with the perimeter of the aperture in the doll portion, such that the perimeter of the aperture and the closing means form a part of the headband. Generally, the crown has an arcuate shape, but may take on any shape appropriate to a hat. Optionally, the hat portion further comprises size adjustment means, which may be of any type known in the art, such as an elastic strip in the headband. The hat portion may also further comprise optional indicia that are typically associated with the doll portion on the exterior of the crown or brim.

In a first configuration, the hat portion is placed within the internal cavity of the doll portion, such that at least a portion of the brim functions as stuffing for the doll head and at least a portion of the crown functions as stuffing for the doll torso. In a second configuration, the hat portion can assume the shape of a wearable hat. Preferably, when the doll/hat is in the shape of a wearable hat, the doll portion can be collapsed and placed within the interior of the crown of the hat, and not be not visible when the hat is worn.

The reversible doll/hat may further comprise means for forming a neck between the head and torso of the doll portion. The neck forming means typically comprises at least one strip of material having a first end attached to the doll portion at a position between the head and torso and a second free end, in a manner that allows the material to be wrapped around the doll portion between the head and torso, constricting the doll portion to form a neck between the head and torso. Alternatively, the means for forming a neck may comprise at least one strip of material that is not attached to the doll portion, and may be wrapped around the doll portion between the head and torso to form the neck. The unattached neck forming means may be tied in place, or may further comprise attachment means to hold the neck forming means in place.

In a first preferred embodiment, the neck forming means comprises a single strip of material having a first attachment means at the second free end, and a second attachment means, complimentary to the first attachment means, fixedly attached to the strip of material between the first and second ends. The single strip of material has a length that is sufficiently long to allow the strip to be wrapped around the doll forming a neck between the head portion and torso portions, so that the first attachment means may be attached to the second attachment means, thereby holding the neck forming means in a position that forms a neck between the head and neck of the doll portion.

In a second preferred embodiment, the neck forming means comprises a pair of strips of material, each having a first end fixedly attached to the doll portion at a position between the head and torso and a second free end having complimentary attachment means, such that the pair of strips may be wrapped around the doll portion between the head portion and the neck portion to form a neck, and the complementary attachment means may be attached one to the other to hold the means for forming a neck in place between the head portion and the torso portion.

DETAILED DESCRIPTION OF THE INVENTION

Figure 1:
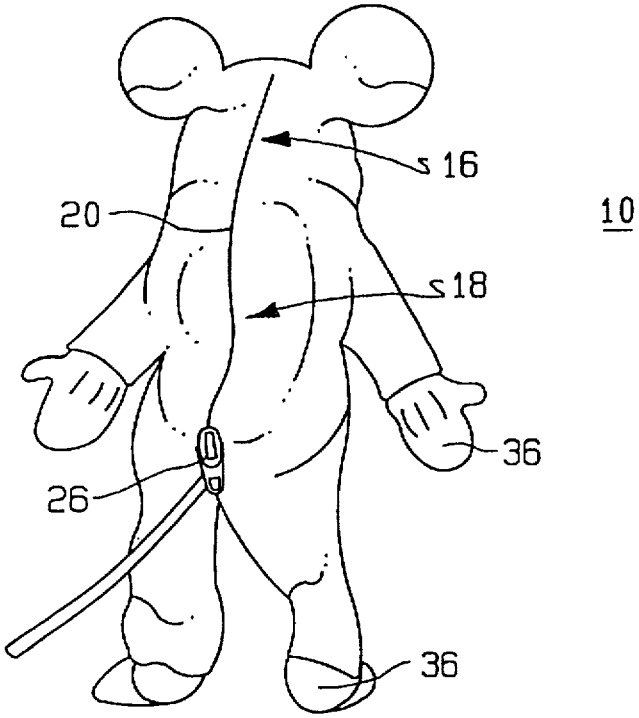
FIG. 1 is an illustration of a typical doll/hat of the invention in which the doll/hat is in the form of a doll, and the aperture into the inner cavity is closed.
Figure 2:
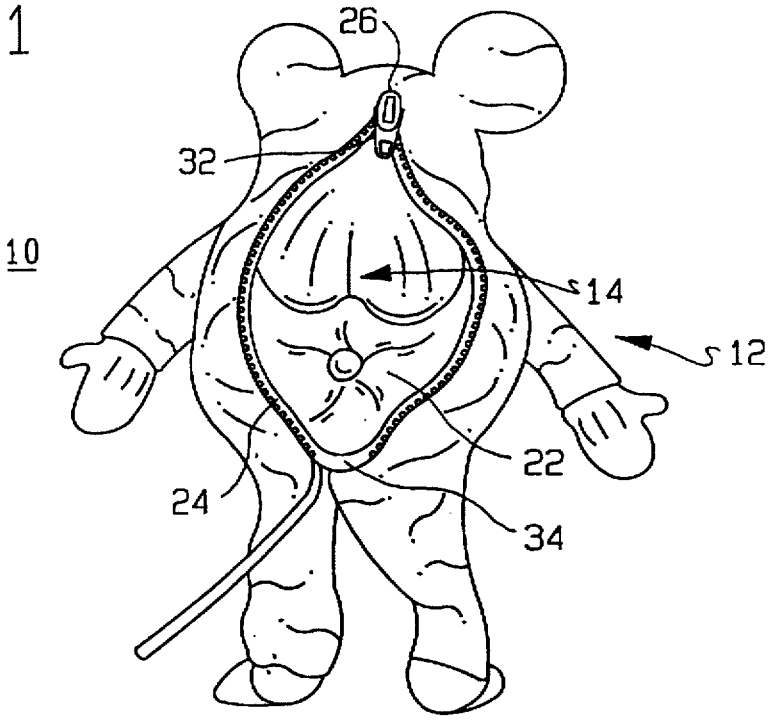
FIG. 2 is an illustration of a typical doll/hat of the invention in which the doll/hat is in the form of a doll, and the aperture into the inner cavity is open.

The reversible doll/hat 10 of the invention comprises a doll portion 12 and a hat portion 14. FIGS. 1 and 2 illustrate the invention where the reversible doll/hat 10 is in the configuration of a doll, which may take on any form common to dolls, including a bear or other animal, a human adult, child or infant, or a cartoon character. The doll portion 12 of the reversible doll/hat 10, comprises a head portion 16 and a torso portion 18 fixedly attached to the head portion 16. The doll portion 12 is typically constructed from a cloth or cloth like material, which is preferably plush and soft to the touch.

An aperture 20 is provided in the doll portion 12 to allow access to an internal cavity 22 defined by and formed within the doll portion 12 of the reversible doll/hat 10. The aperture 20 has a perimeter 24, and may be sealed by closing means 26, which may be a zipper, velcro, buttons, or any other such means known in the art, but is preferably a zipper, as shown in FIGS. 1 and 2. The aperture 20 is typically configured so that the perimeter comprises a first side, a second side, a first end 32, and a second end 34, and also forms a portion of the hat portion 14 as described below. The doll portion 12 may also comprises limbs 36, which may be stuffed or unstuffed. The limbs 36 are not a necessary portion of doll portion 12, and are not included in the doll portion 12 for figures that traditionally lack limbs, such as, e.g., a snowman.

As illustrated in FIG. 2, the hat portion 14 is capable of being folded and placed within the internal cavity 22 of the doll portion 12, where it functions as stuffing for the doll portion 12. However, where limbs 36 of the doll portion 12 are present and stuffed, no portion of the hat portion 14 is typically used as stuffing material for the limbs 36. The hat portion 14 is typically constructed from a pliable cloth-like material that allows the hat portion to be folded for placement within the doll portion 12, but is sufficiently resilient to allow the hat portion 14 to function as a hat after repeatedly being folded and unfolded.

Figure 3:
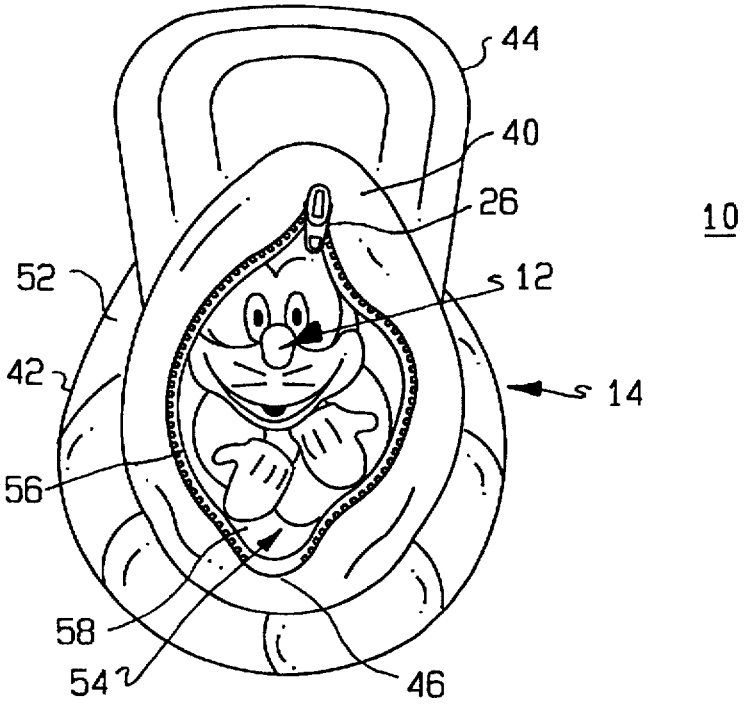
FIG. 3 illustrates the doll/hat of the invention in the form of a hat.
Figure 4:
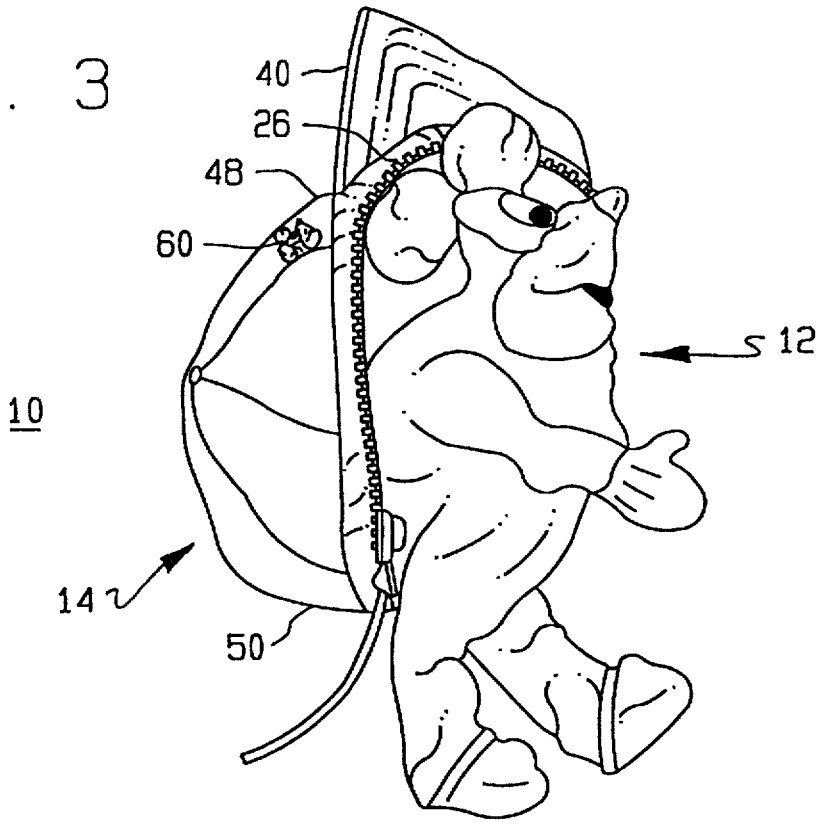
FIG. 4 illustrates a side view of the reversible doll/hat in the process of being manipulated from the doll configuration to the hat configuration.

The hat portion 14 is illustrated in FIG. 3, which illustrates the invention where the reversible doll/hat 10 is in the hat configuration, and in FIG. 4, which illustrates a side view of the reversible doll/hat 10 as it is being manipulated from a doll configuration to a hat configuration. The hat portion 14 of reversible doll/hat 10 comprises a headband 40, a crown 42, and a brim 44.

The crown 42 has a front 48, a back 50, an exterior 52, an interior 54, and an inner periphery 56. The crown 42 defines an internal cavity 58 that is placed over the head of the wearer when worn as a hat. Typically, the crown 42 has an arcuate shape, but may be of any shape appropriate for use in a hat. The brim 44 is typically fixedly attached to the front 48 of crown 42, such as for a baseball cap. However, any type of brim known in the art may be used with the doll/hat of the invention, including a brim 44 that completely encircles the crown 42, such as on a fedora or fishing hat.

The headband 40 is fixedly attached to and extends around the inner periphery 56 of the crown 42, and is associated with the perimeter 24 of the aperture 20 in the doll portion 12 in such a manner that the perimeter 24 of the aperture 20 and the closing means 26 form a part of the headband 40. The exterior 52 of the crown 42 and/or brim 44 may be decorated in any fashion known in the art, or may incorporate indicia 60 that are typically related to the character represented by the doll portion 12. The brim 44 may also be fixedly attached to the headband 40 in addition to the front 48 of the crown 42.

The doll portion 12 is attached to the hat portion 14 in a manner that allows the doll portion 12 to be placed within the internal cavity 58 defined by the crown 42 when the doll/hat is in the configuration of a hat, and the hat portion 14 to be placed with the internal cavity 22 of the doll portion 12 when the doll/hat is in the configuration of a doll. The attachment of the hat portion 14 and doll portion 12 is such that the perimeter 24 of the aperture 20 and the closing means 26 are attached to or are part of headband 40.

Preferably, the hat portion 14 and doll portion 12 are fixedly attached by any means known in the art, such as sewing or gluing, but may also be attached in a manner that allows the hat and doll portions 14 and 12 to be separated and reattached. Preferably, the cavity 58 within crown 42 is sufficiently large that the doll portion 12 may be placed within the cavity 58, so that the hat may be worn with the doll portion 12 within the crown 42. Alternatively, the hat 14 may be worn with part of the doll portion 12, such as the limbs 36, hanging from the back or sides of the hat over the head or neck of the wearer.

The brim 44 and crown 42 are preferably formed from materials that allow the brim 44 and crown 42 to be folded to form the stuffing for the doll head 16 and doll torso 18, yet are sufficiently resilient that when unfolded a useful hat is formed. The materials must be capable of being folded and unfolded repeatedly, and preferably comprise a cloth-like material. Preferably, the brim 44 is formed of a resilient material that provides stiffness, and is covered with cloth or a cloth-like material.

The hat portion 14 may also comprise means for adjusting the size of the hat 46. Preferably, the size adjusting means 46 is located in the headband 40, at a position corresponding to the back 50 of crown 42 and the second end 34 of the aperture 20. The size adjusting means 46 may be of any type known in the art, including, but not limited to an elastic material in the headband 40 to provide a resilient expansion or contraction for enlargement or reduction of the headband 40 to fit the head of the wearer, a pair of molded plastic straps which expand or reduce the size of an opening in the rear of the crown 42, where one of the straps has a plurality of holes and the other strap has a plurality of studs for engaging the holes in releasable locking engagement, or through the use of hook and pile or hook and loop fasteners, typically referred to as Velcro™ fasteners, which may be used in any of a variety of ways for infinite adjustment between preselected minimum and maximum dimensions.

To convert from the doll configuration to the hat configuration, the user opens the closing means 26, and reaches through the aperture 20 into the internal cavity 22 to grasp the hat portion 14, typically by the crown 42. The hat 14 is then pulled from within the cavity 22 in the interior of the doll 12, and the doll portion 12 is placed with in the internal cavity 58 defined by the crown 42.

To convert the hat 14 back to a doll 12, the user reaches within the cavity 58 defined by the crown 42, and pulls the doll portion 12 from within the hat portion 14. The hat 12 is then folded, and pushed through the aperture 20, such that at least a portion of the brim 44 is placed into the head portion 16 of doll portion 12, serving as stuffing for doll head 16, and at least a portion of the crown 42 is placed into the torso portion 18, serving as stuffing for the doll torso 18. Once the hat portion 14 is within doll portion 12, the aperture 20 is closed with the closing means 22, so that the hat portion 14 remains within doll portion 12.

Figure 5:
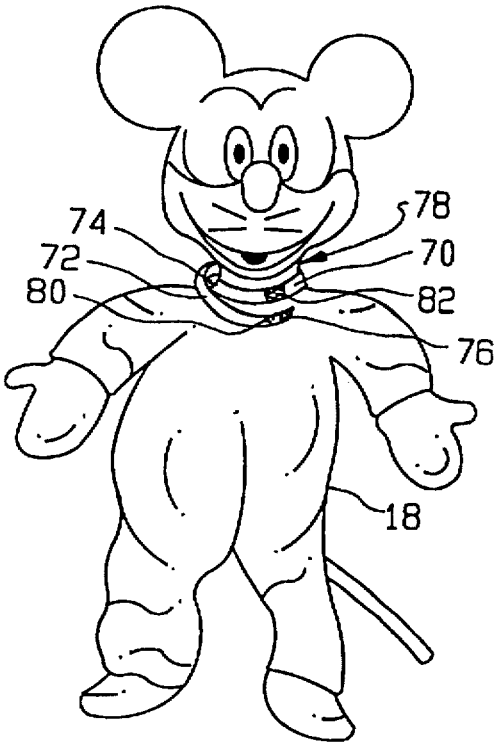
FIG. 5 illustrates one embodiment of the neck forming means.
Figure 6:
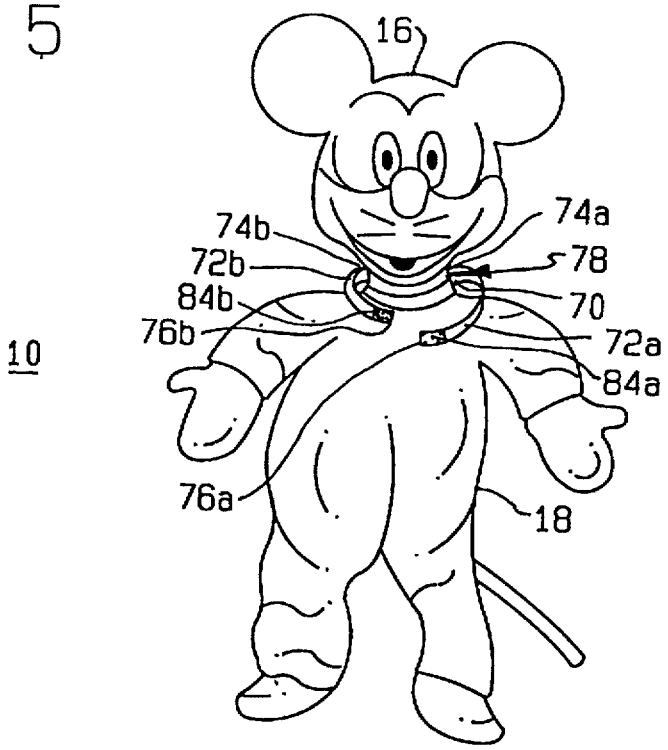
FIG. 6 illustrates a second embodiment of the neck forming means.

The doll portion 12 may also include means for forming a neck 70 between the head 16 and torso 18 of the doll portion 12, as shown in FIG. 5 and FIG. 6. The means for forming a neck 70 typically comprises at least one elongated piece of material 72, such as a ribbon or a cord having a first end 74, which is preferably attached to the doll portion 12 at a position between the head 16 and torso 18, and a second free end 76. The elongated piece of material 72 is sufficiently long to allow the elongated piece of material 72 to be wrapped around the doll portion 12 between the head 16 and torso 18, constricting the doll portion 12 to form a neck 78 between the head 16 and torso 18. In its simplest form, the neck forming means is simply wrapped around the doll portion 12 to form a neck 78, and is tied off to keep the neck forming means 70 in place.

In a first preferred embodiment, as shown in FIG. 5, the means for forming a neck 70 comprises a single strip of material 72 fixedly attached to the doll 12 at the first end 74, a first attachment means 80 at the second free end 76, and a second complimentary attachment means 82 positioned between the first end 74 and the second end 76. The first and second attachment means 80 and 82 may be any means known in the art that allow the first attachment means 80 to be firmly attached to the second complimentary attachment means 82 in a manner that allows the attachment to be opened when desired, such as a button and buttonhole, a hook and loop, a snap type fastener, or any other fastener known in the art, but is preferably Velcro™. The strip of material 72 also has a length that is sufficiently long to allow the strip to be wrapped around the doll 12 forming a neck 78 between the head portion 16 and torso portion 18, and for the first attachment means 80 to be attached to the second attachment means 82 holding the neck forming means 70 in a position that forms a neck 78 between the head 16 and neck 18 of the doll portion 12.

In a second preferred embodiment, as shown in FIG. 6, the means for forming a neck comprises a pair of strips of material **72*a* and 72*b*, each having a first end 74*a* and 74*b* fixedly attached to the doll portion 12 at a position between the head 16 and torso 18 and a second free end 76*a* and 76*b*, each having complimentary attachment means 84*a* and 84*b*, such that the pair of strips 72*a* and 72*b* may be wrapped around the doll portion 12 between the head portion 16 and the neck portion 18 to form a neck 78, and the complementary attachment means 84*a* and 84*b* are attached one to the other to hold the means for forming a neck in place between the head portion 16 and the torso portion 18. The complimentary attachment means 84*a* and 84*b* are substantially the same as the first and second attachment means 80 and 82** described above.

While it is apparent that the invention disclosed herein is well calculated to fulfill the objects stated above, it will be appreciated that numerous modifications and embodiments may be devised by those skilled in the art. For example, larger size dolls or stuffed animals can be combined with larger size hats, such as top hats, stovepipe hats, or cowboy hats, whereas smaller dolls or stuffed animals can be provided in caps or other brimmed hats. Therefore, it is intended that the appended claims cover all such modifications and embodiments as falling within the true spirit and scope of the present invention.

What is claimed is:

1. A reversible doll/hat that can be altered from a doll shape into a wearable hat and vice versa, which comprises a doll portion and a hat portion;

the doll portion defining an internal cavity, and comprising a head portion, a torso portion fixedly attached to the head portion, an aperture having a perimeter that provides access to the internal cavity and closing means for closing the aperture;

the hat portion comprising a crown having a front, a back, an exterior, an interior space configured to receive the doll portion adjacent the crown while providing sufficient space to receive a portion of a wearer's head, an inner periphery, a brim fixedly attached to the crown, and a headband fixedly attached to and extending around the inner periphery of the crown for engaging the wearer's head, the headband associated with the perimeter of the aperture, such that the perimeter of the aperture and the closing means each form part of the headband; and wherein, in a first configuration, the hat portion is placed within the internal cavity of the doll portion, such that at least a portion of the brim functions as stuffing for the head portion and at least a portion of the crown functions as stuffing for the torso portion, and, in a second configuration, the hat portion can assume the shape of a wearable hat.

2. The reversible doll/hat of claim 1, wherein, in the second configuration, the doll portion can be collapsed and placed within the interior space of the crown of the hat portion, with the doll portion not being visible when the hat is worn.

3. The reversible doll/hat of claim 1, wherein the closing means comprises a zipper.

4. The reversible doll/hat of claim 1, wherein the crown has an arcuate shape.

5. The reversible doll/hat of claim 1, further comprising size adjustment means for the headband.

6. The reversible doll/hat of claim 5, wherein the size adjustment means comprises an elastic material that forms part of the headband.

7. The reversible doll/hat of claim 1, further comprising means for forming a neck between the head and torso of the doll portion in the first configuration.

8. The reversible doll/hat of claim 7, wherein the means for forming a neck comprises at least one strip of material having a first end and a second end, such that the material can be wrapped around the doll portion between the head portion and torso portion, constricting the doll portion to form the neck.

9. The reversible doll/hat of claim 8, wherein the means for forming the neck is a single strip of material, wherein the first end is attached to the doll portion at a position between the head portion and torso portion, and the second end is free, and the means for forming the neck comprises a first attachment means at the second free end, a second complimentary attachment means fixedly attached to the strip of material, positioned between the first and second ends, and a length that is sufficiently long to allow the strip to be wrapped around the doll portion forming a neck between the head portion and torso portions, and for the first attachment means to be attached to the second attachment means holding the neck forming means in a position that forms the neck.

10. The reversible doll/hat of claim 7, wherein the means for forming the neck comprises a pair of strips of material, each having a first end fixedly attached to the doll portion at a position between the head portion and torso portion and a second free end having complimentary attachment means, such that the pair of strips may be wrapped around the doll portion between the head portion and the torso portion to form the neck, and the complementary attachment means are attached one to the other to hold the means for forming a neck in place between the head portion and the torso portion.

11. The reversible doll/hat of claim 1, further comprising indicia associated with the doll portion on the exterior of the hat.

12. The reversible doll/hat of claim 1, wherein the doll portion comprises a plush animal, and the hat portion comprises a baseball cap.

13. A reversible doll/hat that can be altered from a doll shape into a wearable hat and vice versa, which comprises a doll portion and a hat portion;

the doll portion comprising a plush animal defining an internal cavity, and comprising a head portion, a torso portion fixedly attached to the head portion, an aperture having a perimeter that provides access to the interior cavity and a zipper for closing the aperture;

the hat portion comprising a baseball cap, which comprises a crown having a front, a back, an exterior, an interior space configured to receive the doll portion adjacent the crown while providing sufficient space to receive a portion of a wearer's head, an inner periphery, a brim fixedly attached at the front of the crown, indicia associated with the doll portion on the exterior of the cap, and a headband fixedly attached to and extending around the inner periphery of the crown for engaging the wearer's head, the headband associated with the perimeter of the aperture, such that the perimeter of the aperture and the zipper each form part of the headband; and wherein, in a first configuration, the hat portion is placed within the internal cavity of the doll portion, such that at least a portion of the brim functions as stuffing for the head portion and at least a portion of the crown functions as stuffing for the torso portion, and, in a second configuration, the hat portion can assume the shape of a wearable baseball cap, where the doll portion can be collapsed and placed within the interior space and adjacent the crown of the hat portion, with the doll portion not being visible when the hat portion is worn.

14. The reversible doll/hat of claim 1, further comprising size adjustment means for the headband.

15. The reversible doll/hat of claim 14, wherein the size adjustment means comprises an elastic strip that forms part of the headband.

16. The reversible doll/hat of claim 1, further comprising means for forming a neck between the head portion and torso portion of the doll portion in the first configuration.

17. The reversible doll/hat of claim 16, wherein the means for forming a neck comprises at least one strip of material having a first end attached to the doll portion at a position between the head portion and torso portion and a second free end, such that the material can be wrapped around the doll portion between the head portion and torso portion, constricting the doll portion to form the neck.

18. The reversible doll/hat of claim 17, wherein the means for forming a neck comprises a single strip of material having a first attachment means at the second free end, a second complimentary attachment means fixedly attached to the strip of material, positioned between the first and second ends, and a length that is sufficiently long to allow the strip to be wrapped around the doll portion forming a neck between the head portion and torso portion, and for the first attachment means to be attached to the second attachment means holding the neck forming means in a position that forms the neck.

19. The reversible doll/hat of claim 16, wherein the means for forming a neck comprises a pair of strips of material, each having a first end fixedly attached to the doll portion at a position between the head and torso and a second free end having complimentary attachment means, such that the pair of strips may be wrapped around the doll portion between the head portion and the torso portion to form the neck, and the complementary attachment means are attached one to the other to hold the means for forming a neck in place between the head portion and the torso portion.

* * * * *